US007930804B2

(12) United States Patent
Cornfield

(10) Patent No.: US 7,930,804 B2
(45) Date of Patent: Apr. 26, 2011

(54) IMPLEMENT HANDLE

(76) Inventor: Randall Cornfield, Montreal (CA)

( * ) Notice: Subject to any disclaimer, the term of this patent is extended or adjusted under 35 U.S.C. 154(b) by 0 days.

(21) Appl. No.: 10/748,857

(22) Filed: Dec. 30, 2003

(65) Prior Publication Data

US 2005/0138777 A1 Jun. 30, 2005

(51) Int. Cl.
*B25G 1/10* (2006.01)

(52) U.S. Cl. ..... 16/430; 16/431; 16/DIG. 18

(58) Field of Classification Search ..... 16/430, 16/431, DIG. 18, DIG. 19, DIG. 12; 30/340, 30/342; 81/173.1, 489
See application file for complete search history.

(56) References Cited

U.S. PATENT DOCUMENTS

| | | | | | |
|---|---|---|---|---|---|
| 1,096,602 | A | * | 5/1914 | Coles | 30/432 |
| 2,421,339 | A | * | 5/1947 | Leger | 30/165 |
| D149,677 | S | * | 5/1948 | Robin | D7/395 |
| D241,806 | S | | 10/1976 | Johnson | |
| D248,616 | S | | 7/1978 | Johnson | |
| D257,686 | S | * | 12/1980 | Silva | D22/118 |
| D261,972 | S | | 11/1981 | Torongo et al. | |
| D283,967 | S | | 5/1986 | Cappadona et al. | |
| 4,645,235 | A | | 2/1987 | Joseph | |
| D295,011 | S | * | 4/1988 | Herron et al. | D7/649 |
| 4,885,818 | A | | 12/1989 | Arterbury | |
| 4,974,286 | A | | 12/1990 | Stowell et al. | |
| 5,075,975 | A | | 12/1991 | Wilson | |
| 5,155,878 | A | | 10/1992 | Dellis | |
| D333,859 | S | * | 3/1993 | Meyer | D22/118 |
| 5,365,666 | A | | 11/1994 | Gonzales | |
| 5,365,881 | A | * | 11/1994 | Sporn | 119/633 |
| D355,831 | S | | 2/1995 | Hull et al. | |
| D356,021 | S | | 3/1995 | Hull et al. | |
| 5,425,591 | A | | 6/1995 | Contreras et al. | |
| D360,013 | S | * | 7/1995 | Collins | D22/118 |
| 5,528,834 | A | | 6/1996 | Seber et al. | |
| 5,535,484 | A | | 7/1996 | Gibson | |
| D373,289 | S | * | 9/1996 | Gebhardt | D7/401.2 |
| D374,795 | S | | 10/1996 | Lie | |
| 5,692,265 | A | | 12/1997 | Dalury | |
| 5,737,803 | A | | 4/1998 | Tisdale | |
| D397,018 | S | * | 8/1998 | Mosley | D8/107 |
| D399,722 | S | | 10/1998 | Eidsmoe et al. | |
| 5,829,099 | A | | 11/1998 | Kopelman et al. | |
| D414,095 | S | | 9/1999 | Hoepfl et al. | |

(Continued)

FOREIGN PATENT DOCUMENTS

| | | |
|---|---|---|
| DE | 3805997 | 9/1988 |
| WO | WO-9106405 | 5/1991 |

*Primary Examiner* — Carlos Lugo
*Assistant Examiner* — Mark Williams
(74) *Attorney, Agent, or Firm* — Dan De La Rosa

(57) ABSTRACT

An implement handle graspable by a hand of an intended user and connectable to an implement head includes a generally elongated body defining a body longitudinal axis, a body forward end for connection to the implement head and a longitudinally opposed body rearward end. The body also defines a body top surface and a substantially opposed body bottom surface. The body is configured so as to define a longitudinal cross-sectional configuration having a substantially fusiform encirclable section tapering rearwards towards the body rearward end and forwardly towards a neck section. The neck section diverges forwardly into an abutment section. The neck and abutment sections together define a thump rest area on the body top surface and an index rest area on the body bottom surface. The abutment section tapers forwardly into a spacing section for spacing the fingers of the intended user from the implement head.

19 Claims, 8 Drawing Sheets

U.S. PATENT DOCUMENTS

| | | | | | |
|---|---|---|---|---|---|
| D414,989 | S | * | 10/1999 | Shamoon | D7/649 |
| 5,975,909 | A | | 11/1999 | Ritchie | |
| D419,039 | S | * | 1/2000 | Rimback | D7/681 |
| D419,040 | S | * | 1/2000 | Rimback | D7/681 |
| 6,065,188 | A | | 5/2000 | Wold et al. | |
| D436,801 | S | | 1/2001 | Wonderley | |
| 6,313,451 | B1 | * | 11/2001 | Vidmar et al. | 219/757 |
| 6,460,255 | B1 | * | 10/2002 | Dassaud | 30/340 |
| 6,502,314 | B1 | * | 1/2003 | McCatty | 30/340 |
| 6,530,125 | B2 | | 3/2003 | Shippert | |
| D476,535 | S | * | 7/2003 | Garon | D7/649 |
| 6,701,624 | B1 | | 3/2004 | White | |

* cited by examiner

IMPLEMENT HANDLE

FIELD OF THE INVENTION

The present invention relates to the general field of handles, and is particularly concerned with an implement handle.

BACKGROUND OF THE INVENTION

The prior art is replete with various types of gripping handles for use with various types of tools or implements. These gripping handles provide a grasping surface for manipulation, allowing an intended user to manually use the tool for its intended function or use.

Grasping of a gripping handle regardless of the type includes four stages. First, opening of the hand, which requires the simultaneous action of the intrinsic muscles of the hand and the long extensor muscles. Second, closing of the fingers to grasp the gripping handle and adapt to the shape of the latter. Third, exertion of a force on the handle, which will vary depending on the weight, surface characteristics, fragility and use of the implement, and its gripping handle. Fourth, release, in which the hand opens to let go of the gripping handle.

In order to provide gripping handles that allow for these four stages to occur satisfactorily while being manufacturable at relatively low costs, most conventional gripping handles have a generally elongated configuration with a substantially constant cross-sectional configuration. Typically, the cross-sectional configuration is disc-shaped, hexagonal or the like.

Such conventional gripping handles are typically grasped using a so-called power grip. With this type of grip, the digits of the user maintain the gripping handle against the palm. The combined effect of joint position brings the hand into line with the forearm. For a power grip to be formed, the fingers are flexed and the wrist is in ulnar deviation and extended. A power grip is typically used when strength or force is the primary consideration.

An example of a power grip is the hook grasp, in which all or the second and third fingers are used as a hook and may involve the interphalangeal joints only or the interphalangeal and metacarpophalangeal joints (the thumb is not involved). Another example is the cylinder grasp, or palmar prehension in which the thumb is used and the entire hand wraps around the entire gripping handle. With the fist grasp, or digital palmar prehension, the hand moves around a narrow gripping handle.

Another type of grip is the so-called precision or prehension grip. Typically, the precision grip is an activity limited mainly to the metacarpophalangeal joints. The palm may or may not be involved, but there is a pulp-to-pulp contact between the thumb and other fingers and the thumb opposes the fingers. This grip is used when accuracy and precision are required.

There are three types of pinch grips. The first is called a three-point chuck, three-fingered, or digital prehension in which palmar pinch, or sub-terminolateral opposition is achieved. With this grip, there is a pulp-to-pulp pinch, and opposition is necessary. An example is holding a pencil. This grip is sometimes called a precision grip with power.

The second pinch grip is the lateral, key, pulp-to-side pinch, lateral prehension, or sub-terminolateral opposition. The thumb and lateral side of the index finger come into contact and may be called a side, lateral or key-pinch. No opposition is needed. An example of this is holding a card or a key.

The third pinch grip is the tip pinch or tip-to-tip prehension, or terminal opposition. With this positioning, the tip of the thumb is brought into opposition with the tip of another finger. This pinch is used for activities requiring fine coordination rather than power.

In other words, the human hand grip typically occurs in either one of two separate planes. Power grips procured in a so-called finger-to-palm plane, which is created between the fingers and the palm of the hand. The precision or prehension grips typically occur in a so-called finger-to-thumb plane created between the index finger and the thumb or the thumb and other fingers.

Although somewhat useful and relatively inexpensive to manufacture, conventional implement gripping handles suffer from numerous drawbacks. One such drawback is that they typically only allow for use of a power-type grip wherein the digits maintain the gripping handle against the palm. Accordingly, they are not well suited for operations requiring accuracy and precision.

In situations requiring both power and precision, such as during various types of culinary operations, precision using conventional handles is typically achieved at the cost of excessive compensation by the hand, wrist and arm of the operator with resultant potential risk for various types of injuries including repetitive-stress types of injuries such as carpal tunnel syndrome or the like.

Another common drawback associated with conventional gripping handles is that they typically do not fit the hand well, allowing only a limited surface area of the hand to contact the gripping handle. A given user is hence required to exert a greater amount of strength to adequately perform a given task. Furthermore, this creates high pressure points on the small portions of the hand contacting the gripping handle which may prove to be uncomfortable and again potentially lead to injuries.

The muscles of the forearm include the flexor digitorum profundus and superficialis, which extend from the elbow into the length of the fingers. When the hand is tightly clasped, for example because of poor fit between the hand and the gripping handle, the muscles of the hand remain in tension and the flexor digitorum is tightly compressed. Furthermore, the hand muscles also compress the radial artery leading to poor arterial circulation to the fingers. This may lead to fatigue over a relatively short operational cycle.

Another drawback associated with conventional gripping handles is that they are poorly designed for certain types of movement such as rotation about the longitudinal axis of the gripping handle and sawing or slicing motion involving translational movement along the longitudinal axis of the gripping handle. Typically, both of these motions are performed more ergonomically with the index and thumb fingers in opposition.

Still furthermore, in situations wherein the use of a given implement may provide some risk of injury if the hand of the intended user either contacts either the implement or its environment, such as when the implement is a knife, most conventional handles suffer from failing to provide adequate safety features. Some kitchen or utility knives include a substantially planer shield adjacent to the forward hand of the handle separating the latter from the blade of the knife and providing the intended user with a pushing surface to facilitate the slicing motion. However, the conventional planer shields typically poorly conform to the configuration of the index finger and, hence, only contact the latter about a relatively small contact surface leading to high pressure points. This relatively high pressure exerted on a small area of the finger may quickly lead to discomfort and/or injury.

Accordingly, there exists a need for an improved implement handle. It is a general object of the present invention to provide such an improved implement handle.

SUMMARY OF THE INVENTION

In accordance with the present invention, there is provided an implement handle graspable by a hand of an intended user and connectable to an implement head, the hand including a thumb, an index finger, a middle finger, a ring finger and a small finger, each extending from a palm, each of the fingers including a pair of corresponding finger lateral surfaces and a corresponding distal pulp; the implement handle comprising: a generally elongated body defining a body longitudinal axis, a body forward end for connection to the implement head and a longitudinally opposed body rearward end; the body also defining a body top surface and a substantially opposed body bottom surface; the body defining an encirclable section located intermediate the body forward and rearward ends, the encirclable section being configured and sized so as to be graspable between at least a portion of the palm and at least a portion of at least either one of the middle, ring or small fingers at least partially encircling the encirclable section; the body top surface being provided with an identifiable thumb rest area located intermediate the encirclable section and the body forward end for contacting at least a portion of the distal pulp of the thumb, the thumb rest area defining a rest area forwardmost location; the body bottom surface being provided with a substantially concave indentation defining an indentation surface located intermediate the encirclable section and the body forward end for contacting at least a portion of one of the finger lateral surfaces of the index finger with the latter in substantially perpendicular relationship with the body longitudinal axis; the indentation surface having a substantially arcuate cross-sectional configuration defining an indentation first end located substantially adjacent the encirclable section and an indentation second end located substantially adjacent to the body forward end; the body defining a cross-sectional first reference plane extending in a substantially perpendicular relationship with the body longitudinal axis and in register with the indentation second end, the indentation surface being configured and sized so that at least a section of the indentation surface is positioned forwardly relative to the first reference plane.

Conveniently, the thumb rest area is longitudinally offset relative to the indentation, the thumb rest area being located substantially forwardly relative to the indentation. Typically, the indentation surface defines an indentation surface forwardwost location; the body defines a cross-sectional second reference plane intercepting both the indentation surface forwardmost location and the rest area forwardmost location; the second reference plane being angled relative to the first reference plane by a first-to-second reference plane angle.

Conveniently, the thumb rest area has a substantially concave configuration. Typically, the thumb rest area has a substantially saddle-shaped configuration. Typically, the encirclable section has a substantially convex configuration, the encirclable section being configured and sized for substantially conforming to the substantially concave configuration of the palm when the encirclable section is grasped between the palm and the middle, ring or small fingers encircling the encirclable section. Conveniently, at least part of the body bottom surface further defines a bottom abutment section, the bottom abutment section for abuttingly contacting the index, middle, ring and small fingers.

Typically, at least part of the body upper surface further defines a thumb positioning section located substantially adjacent the thumb rest area, the thumb positioning section being configured and sized for allowing at least part of the distal pulp of the thumb to abuttingly rest on the thumb rest area while the encirclable section is grasped between at least a portion of the palm and at least a portion of at least either one of the middle, ring or small fingers at least partially encircling the encirclable section.

Conveniently, the implement handle further comprises a spacing section for spacing the fingers from the implement head, the spacing section extending between the body forward end and between both the indentation and the thumb rest area.

In accordance with the present invention, there is also provided an implement handle graspable by a hand of an intended user and connectable to an implement head, the hand including a thumb, an index finger, a middle finger, a ring finger and a small finger, each extending from a palm, each of the fingers including a pair of corresponding finger lateral surfaces and a corresponding distal pulp; the implement handle comprising: a generally elongated body defining a body longitudinal axis, a body forward end for connection to the implement head and a longitudinally opposed body rearward end; the body also defining a body top surface and a substantially opposed body bottom surface; the body defining a substantially fusiform encirclable section located intermediate the body forward and rearward ends, the encirclable section being configured and sized so as to be graspable between at least a portion of the palm and at least a portion of at least either one of the middle, ring or small fingers at least partially encircling the encirclable section; the body top surface being provided with a visually identifiable thumb rest area located intermediate the encirclable section and the body forward end for contacting at least a portion of the distal pulp of the thumb, the thumb rest area defining a rest area forwardmost location; the body bottom surface being provided with a substantially concave indentation defining an indentation surface located intermediate the encirclable section and the body forward end for contacting at least a portion of one of the finger lateral surfaces of the index finger with the latter in substantially perpendicular relationship with the body longitudinal axis; the body further defining a spacing section for spacing the fingers from the implement head, the spacing section extending between the body forward end and between both the indentation and the thumb rest area.

In accordance with the present invention, there is further provided an implement handle graspable by a hand of an intended user and connectable to an implement head, the hand including a thumb, an index finger, a middle finger, a ring finger and a small finger, each extending from a palm, each of the fingers including a pair of corresponding finger lateral surfaces and a corresponding distal pulp; the implement handle comprising: a generally elongated body defining a body longitudinal axis, a body forward end for connection to the implement head and a longitudinally opposed body rearward end; the body also defining a body top surface and a substantially opposed body bottom surface; the body being configured so as to define a longitudinal cross-sectional configuration having a substantially fusiform encirclable section tapering rearwards towards the body rearward end and frontwardly towards a neck section, the neck section diverging frontwardly into an abutment section, the neck and abutment sections together defining a thump rest area on the body top surface and an index rest area on the body bottom surface; the abutment section tapering frontwardly into a spacing section for spacing the fingers from the implement head.

Conveniently, the neck section defines a top surface nadir and a bottom surface nadir, the top surface nadir being forwardly offset relative to the bottom surface nadir; the abutment section defines a top surface peek and a bottom surface peek, the top surface peek being forwardly offset relative to the bottom surface peek.

Advantages of the present invention include that the proposed implement handle is ergonomically designed to minimize fatigue and the risk of repetitive stress-type injuries.

The proposed implement handle is adapted to be used with a variety of implement including various types of culinary, carpentry, gardening implements or the like and may even be used in sporting equipment of any other suitable field.

Furthermore, the proposed implement handle allows for gripping thereof through a combination of power and precision grips, hence allowing for a firm grip to be obtained without sacrificing on precision and accuracy.

By allowing for a higher degree of control of the movement of the implement, the proposed implement handle also reduces the risk of overt-type injury. Still furthermore, the proposed implement handle inherently reduces the risk of overt-type injury by providing a shield adapted to conform to the shape of the index of the intended user.

The shield or index indentation further provides an ergonomically designed surface against which the index of the intended user may rest or apply pressure onto during certain types of movement such as a sawing motion or the like.

The proposed implement handle is specifically designed so as to ergonomically conform to the general configuration of the hand of an intended user and fill the latter so as to provide a more stable, secure and comfortable grip.

The proposed implement handle is also specifically designed so as to allow the fingers of the intended used to be flexed separately at the metacarpophalangeal and proximal interphalangeal joints so that their respective axes converge towards the scaphoid tubercle according to their normal physiological flexed alignment.

Yet still furthermore, the proposed implement handle is designed so as to facilitate quick and easy ergonomical positioning of the hand of the intended user thereon. Also, the proposed implement handle is designed as to be esthetically pleasing.

Furthermore, the proposed implement handle is designed so as to be easily cleaned through conventional cleaning operations. Yet still furthermore, the proposed implement handle is designed so as to be manufacturable using conventional forms of manufacturing in conventional materials so as to provide an implement handle that will be economically feasible, long lasting and relatively trouble free in operation.

BRIEF DESCRIPTION OF THE DRAWINGS

Various embodiments of the present invention will now be disclosed, by way of example, in reference to the following drawings in which, FIG. 1, in an elevational view illustrates an implement handle in accordance with an embodiment of the present invention, the implement handle being shown grasped by the hand of an intended user.

DETAILED DESCRIPTION

Figure 1:
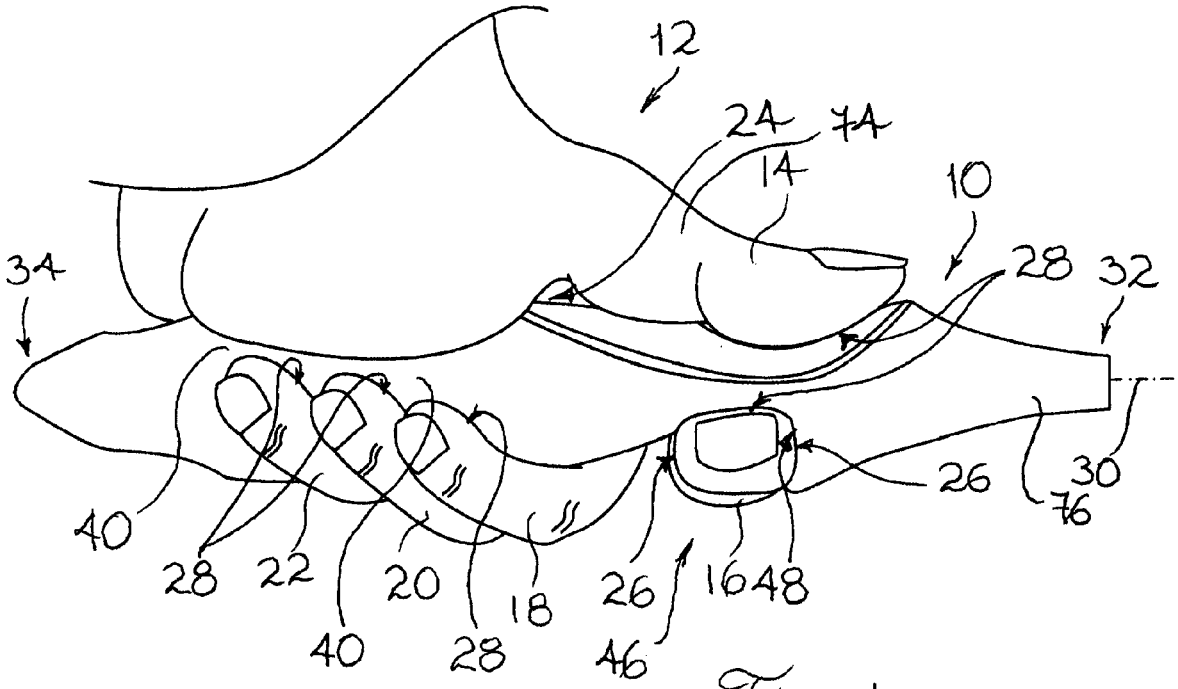

Referring to FIG. 1, there is shown an implement handle, in accordance with an embodiment of the present invention, generally indicated by the reference numeral 10. The handle 10 is shown being grasped by a hand 12 of an intended user. The hand 12 includes a thumb 14, an index finger 16, a middle finger 18, a ring finger 20 and a small finger 22.

Each finger 14 through 22 extends from a palm 24. Each finger 14 through 22 includes a pair of corresponding finger lateral surfaces 26 and a corresponding distal pulp 28.

Throughout the Figures, the implement handle 10 is shown in isolation. However, in use, the implement handle 10 is typically connected or attached to an implement head (not shown). The implement head (not shown) may take any suitable form without departing from the scope of the present invention.

By way of example, the implement handle 10 could be connected to the implement head of a culinary implement such as a knife, a ladle, a spoon, a whisk or any other suitable culinary implement. The implement handle 10 could also be connected to implement heads in other fields such as that of a hammer, a scrapper, a small shovel or the like.

Also, throughout the Figures, the implement handle 10 is shown deprived of a connecting means for connection to the implement head. It should however be understood that the implement handle 10 could be provided with any suitable connecting, coupling or attachment means without departing from the scope of the present invention. For example, the handle—to—implement head connecting means may be of the releasable type or of the permanent type without departing from the scope of the present invention.

Referring now more specifically to FIGS. 2 through 7, there is shown that the implement handle 10 has a generally elongated body defining a body longitudinal axis 30, a body forward end 32 for connection to the implement head (not shown) and a longitudinally opposed body rearward end 34. The implement handle 10 also defines a body top surface 36 and a substantially opposed body bottom surface 38.

The implement handle 10 also defines a graspable or encirclable section 40 located intermediate the body forward and rearward ends 32, 34. As illustrated more specifically in FIG. 1, the encirclable section 40 is configured and sized so as to be graspable between at least a portion of the palm 24 and at least a portion of at least either one of the middle, ring or small fingers, 18, 20, 22, at least partially encircling the encirclable section 40.

It should be understood that although FIG. 1 illustrates the encirclable section 40 being encircled by all of the middle, ring and small fingers, 18, 20 and 22, the encirclable section can also be configured and sized so as to be encircled by only one of the middle, ring or small fingers, 18, 20, 22 without departing from the scope of the present invention. Also, although FIG. 1 illustrates the encircle section 40 as being almost totally encircled by the middle, ring and small fingers, 18, 20 and 22, the encirclable section 40 can be configured and sized so as to be fully encircled or even less encircled than shown in FIG. 1 without departing from the scope of the present invention.

Figures 2, 3:
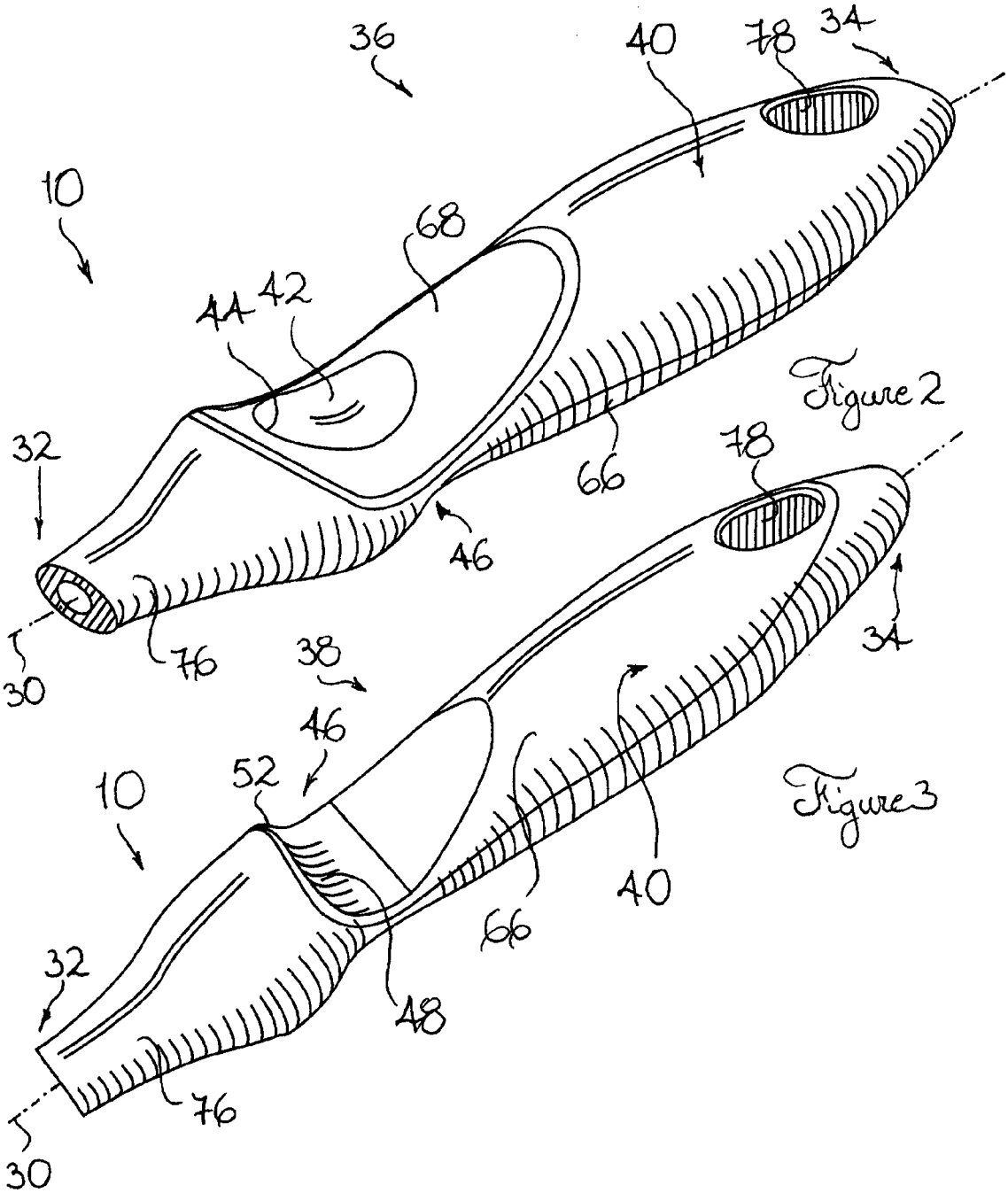
FIG. 2, in a top perspective view, illustrates the implement handle shown in FIG. 1.
FIG. 3, in a bottom perspective view, illustrates the implement handle shown in FIGS. 1 and 2.
Figure 5:
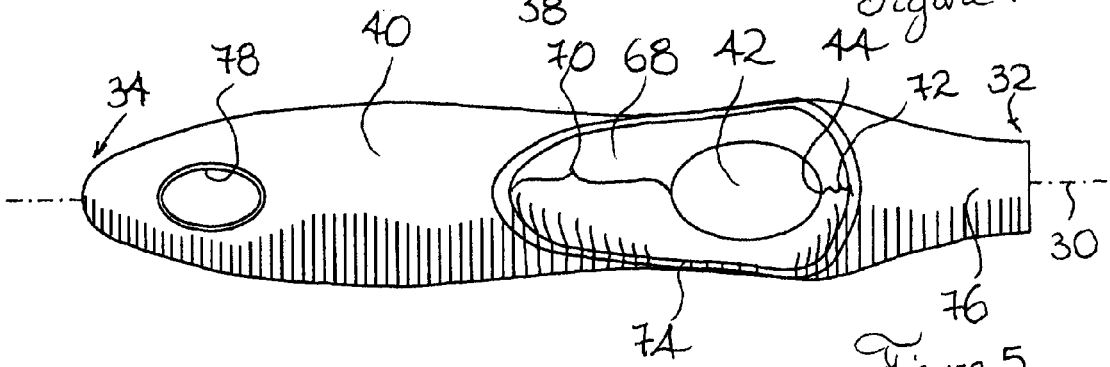
FIG. 5, in a top view, illustrates the implement handle shown in FIGS. 1 through 4.
Figure 6:
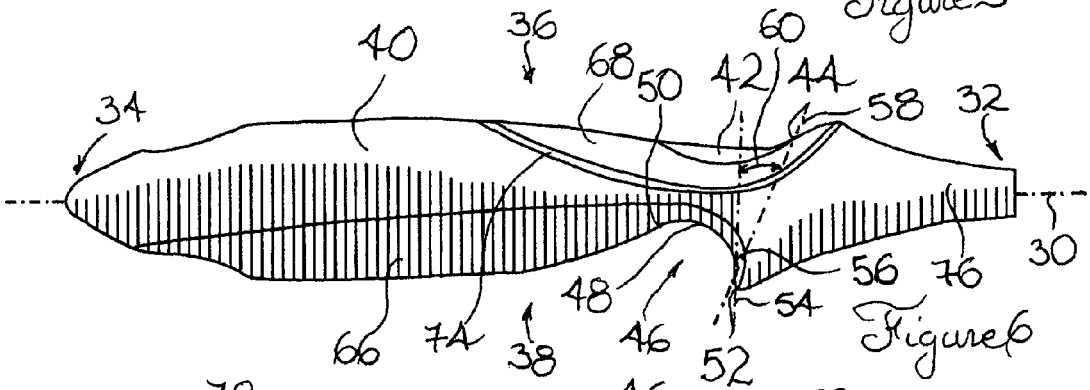
FIG. 6, in an elevational view, illustrates the implement handle shown in FIGS. 1 through 5.

As shown more specifically in FIGS. 2, 5 and 6, the body top surface 36 is provided with an identifiable thumb rest area 42 located intermediate the encirclable section 40 and the body forward end 32. Although the thumb rest area 42 is shown throughout the Figures as being visually identifiable, it should be understood that the thumb rest area could be actually or otherwise identifiable without departing from the scope of the present invention.

The thumb rest area 42 is adapted to contact at least a portion of the distal pulp 28 of the thumb 14. Although the thumb rest area 42 is shown in FIG. 1 as contacting most of the distal pulp 28 of the thumb 14, it should be understood that the thumb rest area 42 could be otherwise configured and sized for contacting a smaller or greater portion of the distal pulp 28 of the thumb 14 than that shown in FIG. 1. The thumb rest area 42 defines a rest area forwardmost location 44 adapted to contact the forwardmost portion of the distal pulp 28 of the thumb 14.

As shown more specifically in FIGS. 1, 3, 4, 6 and 7, the body bottom surface 38 is provided with a substantially concave indentation 46 defining an indentation surface 48 located intermediate the encirclable section 40 and body forward end 32. As illustrated more specifically in FIG. 1, the indentation surface 48 is adapted to contact at least a portion of one of the finger lateral surfaces 26 of the index finger 16 with the latter in a substantially perpendicular relationship with the body longitudinal access 30.

Figure 16:
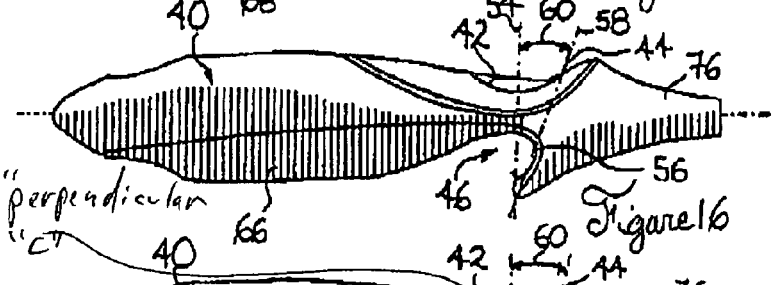
FIG. 16, in an elevational view, illustrates the configuration of the implement handle in accordance with an alternative embodiment of the invention wherein the index indentation thereof has a different configuration than that of other implement handles shown throughout the figures.
Figure 17:
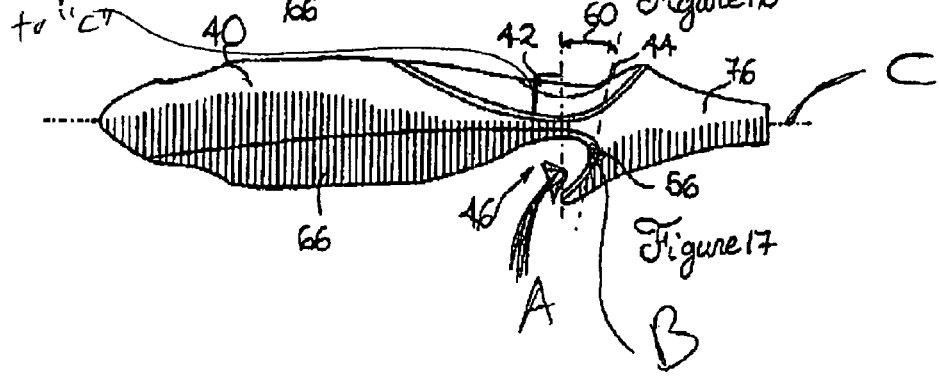
FIG. 17, in an elevational view, illustrates the configuration of the implement handle in accordance with an alternative embodiment of the invention wherein the index indentation thereof has a different configuration than that of other implement handles shown throughout the figures.
Figure 18:
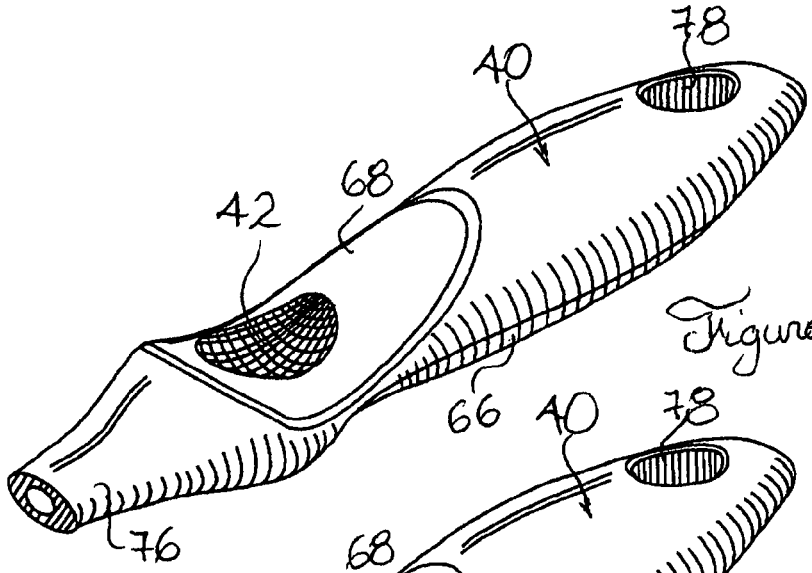
FIG. 18, in a top perspective view, illustrates the implement handle in accordance with yet another alternative embodiment of the invention, the implement handle having the thumb rest region different than that of other implement handles shown throughout the figures.

It should be understood that although the indentation surface 48 as shown in FIG. 1 contacts most of the lateral surface 26 of the index finger 16, the indentation surface 48 could be otherwise configured and sized for contacting more or less of the lateral surface 26 of the index FIG. 16 than that shown in FIG. 1.

Figure 4:
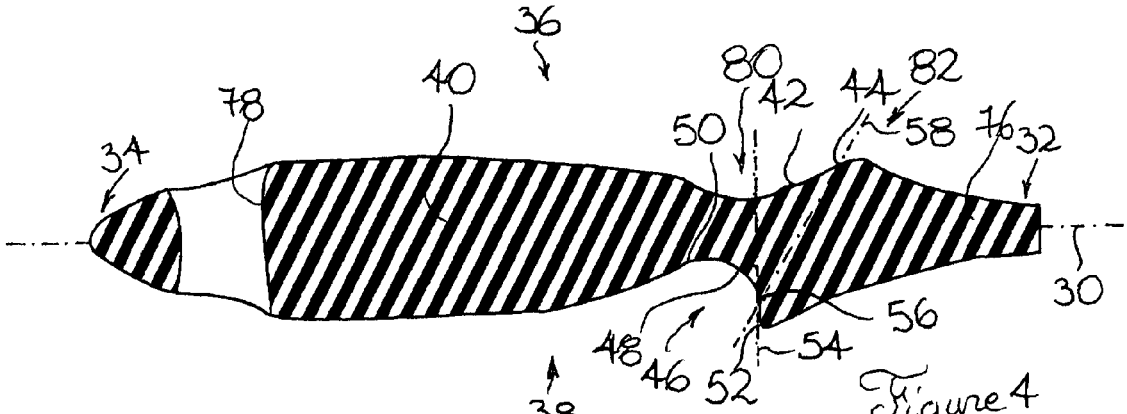
FIG. 4, in a longitudinal cross-sectional view, illustrates the implement handle shown in FIGS. 1 through 3.

As illustrated more specifically in FIGS. 4 and 6, the indentation surface 48 has a substantially hook-shaped or arcuate cross-sectional configuration defining an indentation first end 50 located substantially adjacent the encirclable section 40 and an indentation second end 52 located substantially adjacent to the body forward end 32. For explanation purposes, the body of the implement handle 10 defines a cross-sectional first reference plane 54 extending in a substantially perpendicular relationship with the body longitudinal access 30 and in register with the indentation second end 52. The indentation surface 48 is configured and sized so that at least a section of the indentation surface 48 is positioned forwardly relative to the first reference plane 54.

Again, it should be understood that the configuration and size of the indentation surface 48 could vary without departing from the scope of the present invention. For example, FIGS. 14 through 17 illustrate examples of alternative embodiments wherein the configuration and size of the indentation surface 48 provides an increasingly greater portion of the indentation surface 48 being positioned forwardly relative to the first reference plane 54.

The thumb rest area 42 is typically longitudinally offset relative to the indentation 46. The thumb rest area 42 is typically located substantially forwardly relative to the indentation 46. The indentation surface 48 defines an indentation surface forwardmost location 56.

For explanation purposes, the body of the implement handle 10 defines a cross-sectional second reference plane 58 intercepting both the indentation surface forwardmost location 56 and the rest area forwardmost location 44. The second reference plane 58 is angled relative to the first reference plane 54 by a first-to-second reference plane angle 60. The first-to-second reference plane angle 60 typically has a value of between approximately 20 degrees and 80 degrees.

In the embodiments of the invention shown throughout the Figures, the thumb rest area 42 has a substantially oval configuration with the long axis of the oval configuration substantially aligned with the body longitudinal axis 30. It should however be understood that the thumb rest area 42 could have other configurations such as that of a disk, a square, a rectangle or the like and be otherwise aligned relative to the body longitudinal axis 30 without departing from the scope of the present invention.

In the embodiments of the invention shown in FIGS. 1 through 18, the thumb rest area 42 has a substantially concave configuration and a substantially saddle-shaped configuration defined by a pair of distinct radiuses of curvature. It should however be understood that the thumb rest area 42 could have other configurations without departing from the scope of the present invention.

Figure 19:
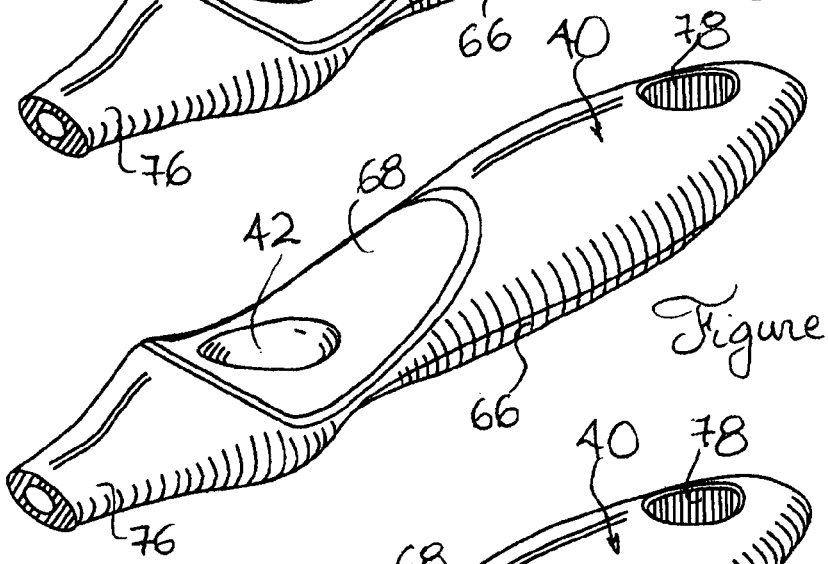
FIG. 19, in a top perspective view, illustrates the implement handle in accordance with yet another alternative embodiment of the invention, the implement handle having the thumb rest region different than that of other implement handles shown throughout the figures.

In at least some embodiments of the invention, the thumb rest area 42 is topographically different than an area adjacent thereto so as to facilitate the differentiation thereof. For example, in the embodiment shown in FIG. 18, the thumb rest area 42 is recessed relative to an adjacent area thereof so as to facilitate the differentiation therewith. Also, for example, in the embodiment shown in FIG. 19, the thumb rest area 42 protrudes relative to an adjacent area thereof so as to facilitate the differentiation therewith.

Figure 20:
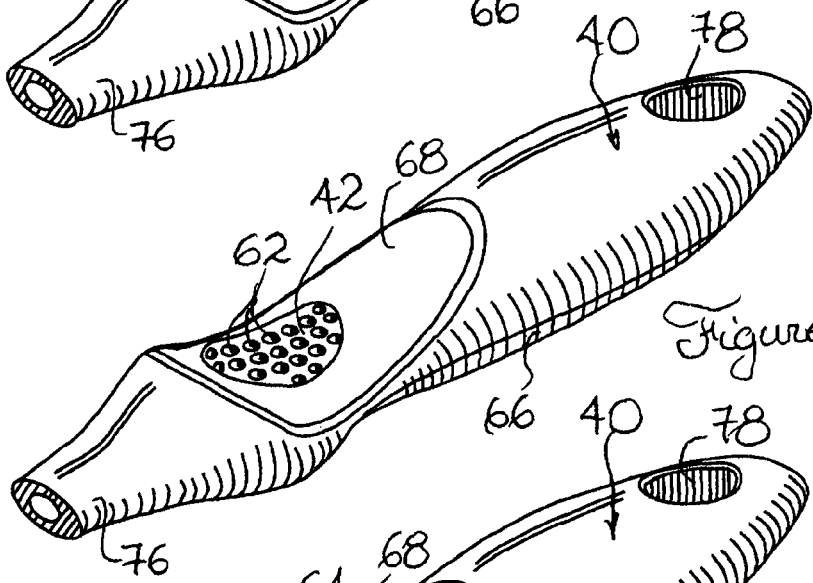
FIG. 20, in a top perspective view, illustrates the implement handle in accordance with yet another alternative embodiment of the invention, the implement handle having the thumb rest region different than that of other implement handles shown throughout the figures.

In at least some embodiments of the invention, the thumb rest area 42 has a different surface texture than that of an adjacent are thereof so as to facilitate the differentiation therewith. For example, in at least some embodiments of the invention, the thumb rest area 42 is provided with a friction enhancing surface texture. By further way of example, the embodiment shown in FIG. 20 is provided with friction enhancing protrusions 62 extending therefrom. It should be understood that other types of surface textures could be used without departing from the scope of the present invention.

Figure 21:
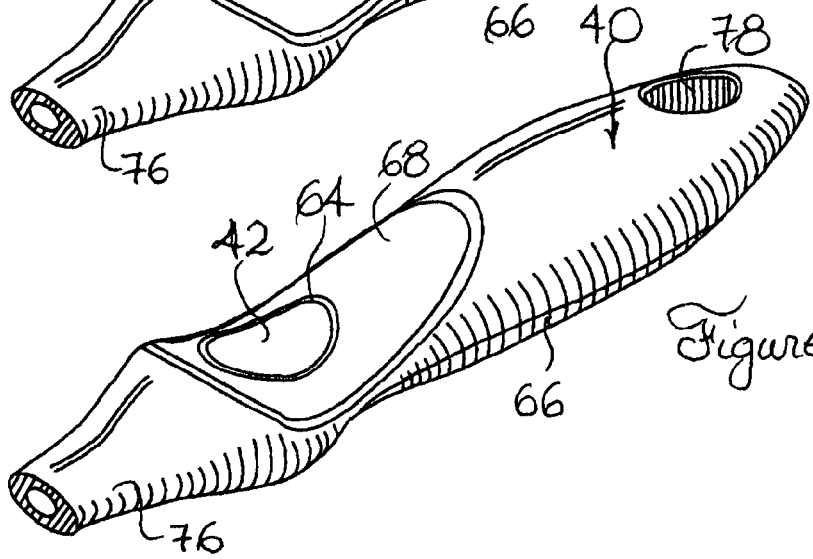
FIG. 21, in a top perspective view, illustrates the implement handle in accordance with yet another alternative embodiment of the invention, the implement handle having the thumb rest region different than that of other implement handles shown throughout the figures.
Figure 22:
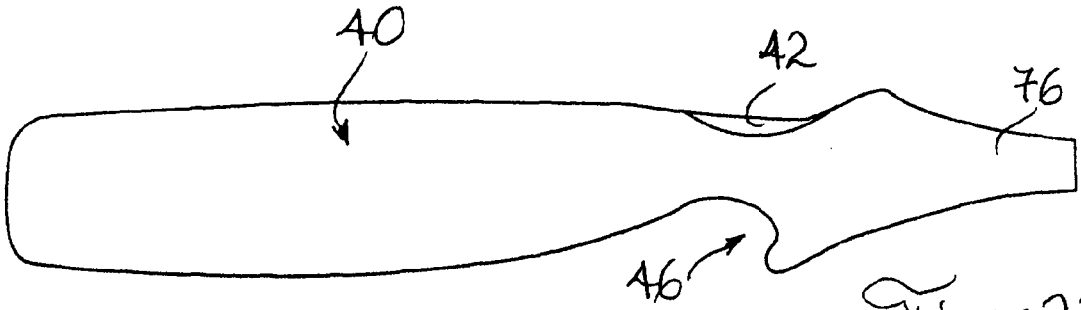
FIG. 22, in an elevational view, illustrates the implement handle in accordance with yet another alternative embodiment of the invention, the implement handle having an encirclable portion thereof with a configuration other than that of other implement handles shown throughout the figures.
Figure 23:
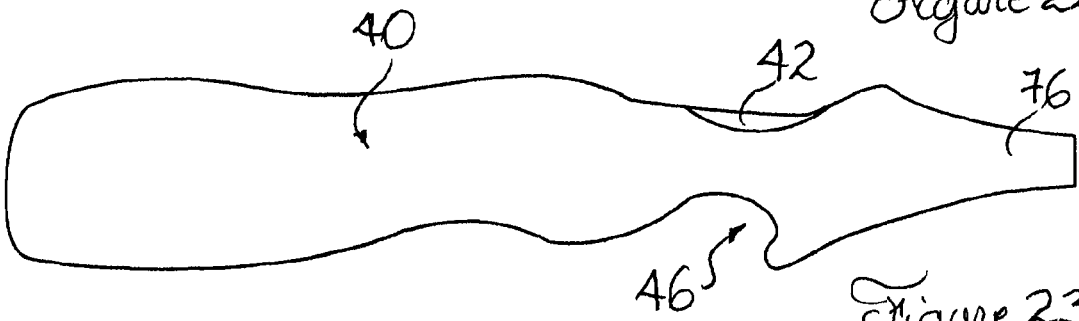
FIG. 23, in an elevational view, illustrates the implement handle in accordance with yet another alternative embodiment of the invention, the implement handle having an encirclable portion thereof with a configuration other than that of other implement handles shown throughout the figures.
Figure 24:
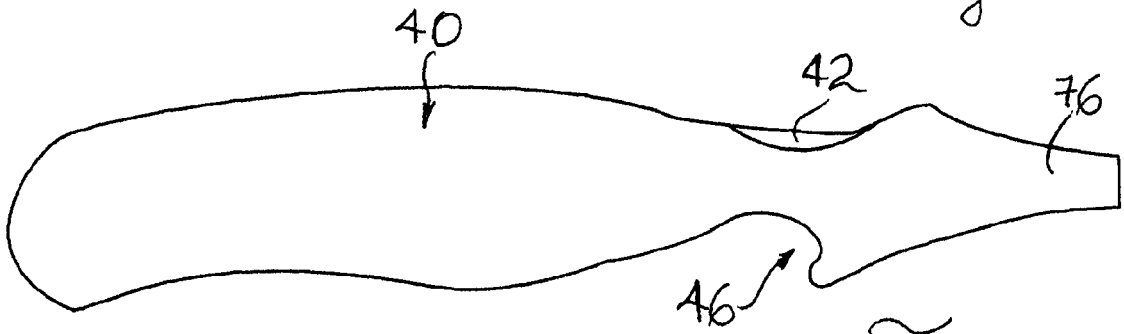
FIG. 24, in an elevational view, illustrates the implement handle in accordance with yet another alternative embodiment of the invention, the implement handle having an encirclable portion thereof with a configuration other than that of other implement handles shown throughout the figures.
Figure 25:
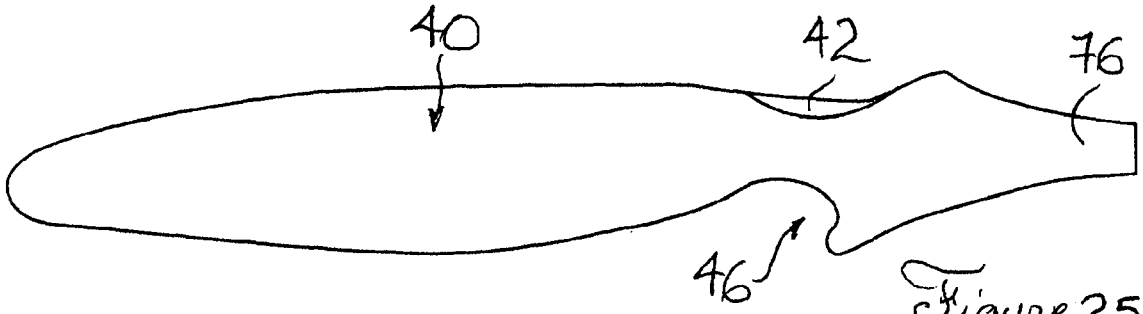
FIG. 25, in an elevational view, illustrates the implement handle in accordance with yet another alternative embodiment of the invention, the implement handle having an encirclable portion thereof with a configuration other than that of other implement handles shown throughout the figures.

In at least some embodiments of the invention, the thumb rest area 42 is provided with a visually distinguishable thumb area edge so as to facilitate the differentiation thereof relative to an adjacent section. By way of example, in the embodiments shown in FIG. 21, the thumb area edge includes a peripheral rim 64.

In the embodiments of the invention shown in FIGS. 1 through 21, the encirclable section 40 has a substantially convex configuration and is configured and sized for substantially conforming to the substantially concave configuration of the palm 24 when the encirclable section 40 is grasped between the palm 24 and the middle, ring and small fingers 18, 20 and 22 encircling the encirclable section 40.

As illustrated more specifically in FIGS. 4 through 7, in at least some embodiments of the invention, the encirclable section 40 has a substantially fusiform configuration tapering rearwards towards the body rear end 34 and also tapering forwardly towards both the thumb rest area 42 and the indentation 46. As illustrated more specifically in FIGS. 8 through 13, the encirclable section 40 typically has a substantially asymmetrically flattened fusiform configuration with the transversal cross-sectional configuration of the body top surface 36 having a greater radius of curvature than that of said body bottom surface 38.

It should however be understood that the encirclable section 40 could have other configurations without departing from the scope of the present invention. For example, FIGS. 22-25 illustrate alternative embodiments of the invention wherein the encirclable section 40 has different yet ergonomical configurations.

Figure 7:
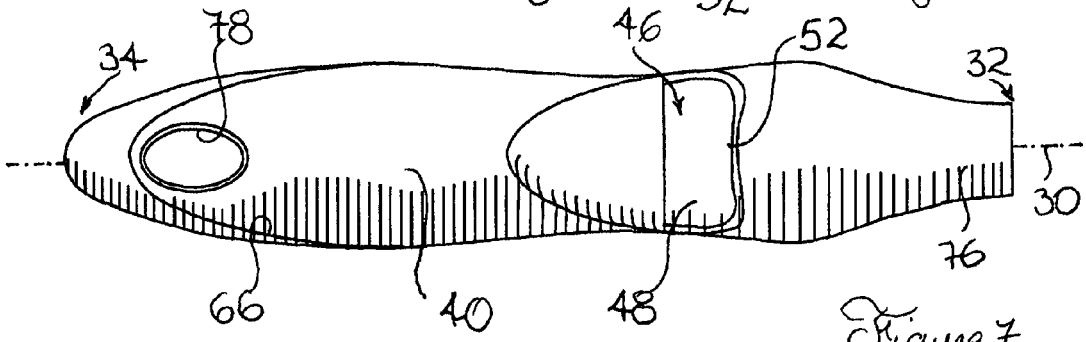
FIG. 7, in a bottom view, illustrates the implement handle shown in FIGS. 1 through 6.
Figure 8:
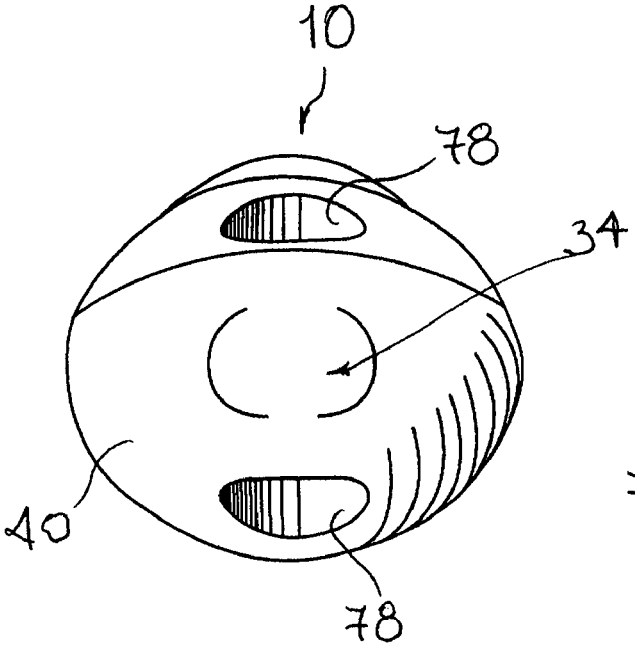
FIG. 8, in a rear view, illustrates the implement handle shown in FIGS. 1 through 7.
Figure 9:
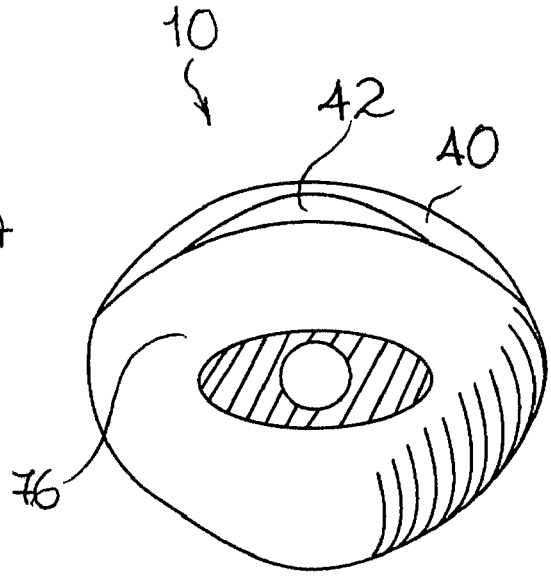
FIG. 9, in a front view, illustrates the implement handle shown in FIGS. 1 through 8.
Figure 10:
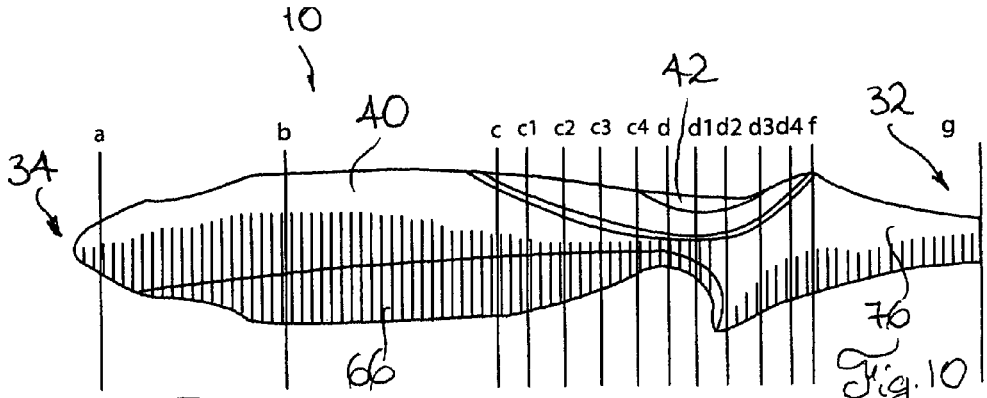
FIG. 10, in an elevational view, illustrates the implement handle shown in FIGS. 1 through 9 with transversal cross-sectional planes extending there across.
Figure 11:
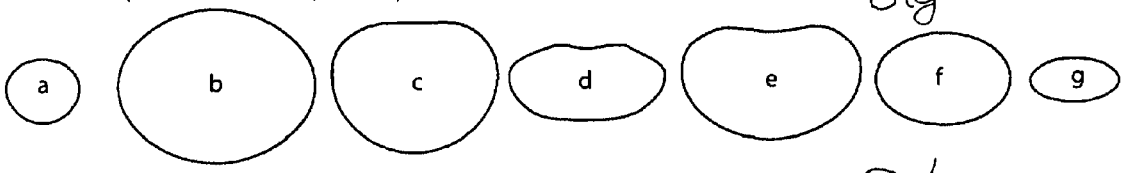
FIG. 11, in a transversal cross-sectional view, illustrates the configuration of the implement handle shown in FIG. 10 at various longitudinal locations there along.
Figure 12:
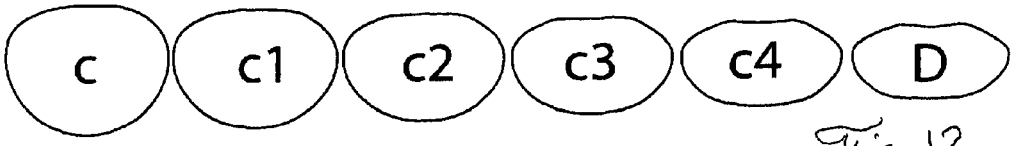
FIG. 12, in a transversal cross-sectional view, illustrates the configuration of the implement handle shown in FIG. 10 at various longitudinal locations there along.
Figure 13:
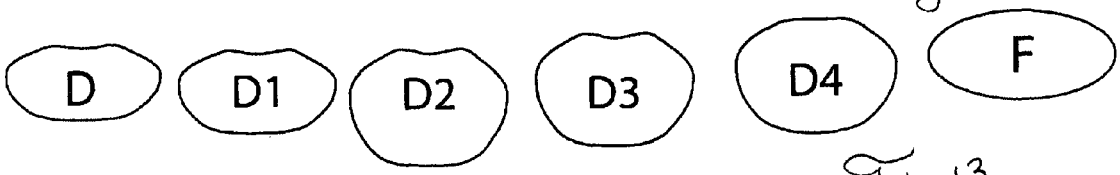
FIG. 13, in a transversal cross-sectional view, illustrates the configuration of the implement handle shown in FIG. 10 at various longitudinal locations there along.
Figure 14:
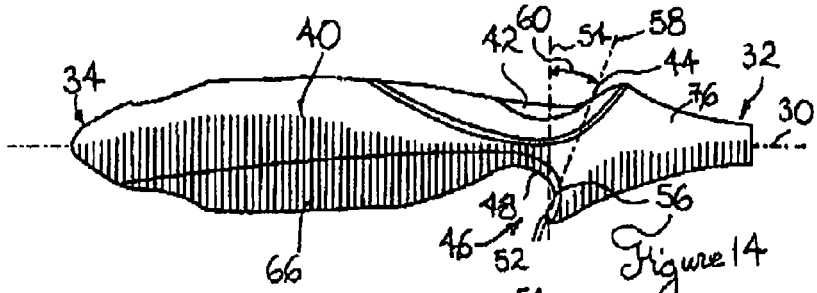
FIG. 14, in an elevational view, illustrates the configuration of the implement handle in accordance with an alternative embodiment of the invention wherein the index indentation thereof has a different configuration than that of other implement handles shown throughout the figures.
Figure 15:
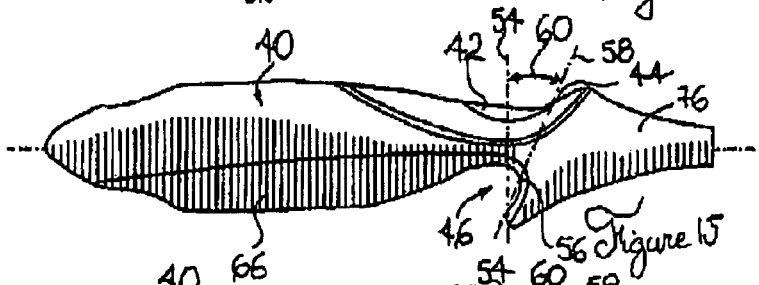
FIG. 15, in an elevational view, illustrates the configuration of the implement handle in accordance with an alternative embodiment of the invention wherein the index indentation thereof has a different configuration than that of other implement handles shown throughout the figures.

As illustrated more specifically in FIGS. 6 and 7 and in least some embodiments of the invention, at least part of the body bottom surface 38 further defines a bottom abutment section 66 for abuttingly contacting the index, middle, ring and small fingers 16 through 22. Typically, although by no means exclusively, the body bottom surface 66 is made out of a different material than that of an adjacent area.

In at least some embodiments of the invention, the bottom abutment section 66 is made out of a substantially resilient material. For example, the bottom abutment section 66 may be made out of an elastomeric resin. In at least one embodiment of the invention, the bottom abutment section 66 is made out of Santoprene (a trade mark).

In at least some embodiments of the invention, the bottom abutment section 66 extends at least partially across the encirclable section 40. Typically, the bottom abutment section 66 extends at least partially across the indentation surface 48. In the embodiments of the invention shown throughout the Figures, the bottom abutment section 66 extends at least partially across both the encirclable section 40 and the indentation surface 46.

As illustrated more specifically in FIGS. 5 and 6, at least part of the body upper surface 36 further defines a thumb positioning section 68 located substantially adjacent to the thumb rest area 42. The thumb positioning section 68 is configured and sized for allowing at least part of the distal pulp 28 of the thumb 14 to abutingly rest on the thumb rest area 42 while the encirclable section 40 is grasped between at least a portion of the palm 24 and at least a portion of at least either one of the middle, ring or small fingers 18 through 22 at least partially encircling the encirclable section 40.

The thumb positioning section 68 preferably fully encircles the thumb rest area 42. In at least some embodiments of the invention, the thumb positioning section 68 has a substantially saddle-shaped configuration. Also, in at least some embodiments of the invention, the thumb rest area 42 is offset forwardly relative to the thumb positioning section 68.

In the embodiments of invention shown in FIGS. 1 through 21, the thumb positioning section 68 defines a positioning section rearward portion 70 located rearwards relative to the thumb rest area 42 and a positioning section forward portion 72 located forwardly relative to the thumb rest area 42. Typically, the positioning section rearward portion 70 is slanted forwardly so as to provide a clearance for the thumb first phalange 74.

Although the thumb first phalange 74 is shown in abutting contact with the positioning section first rearward portion 70 in FIG. 1, it should be understood that the thumb first phalange 74 could be in other ergonomical configurations relative to the positioning section rearward portion 70 without departing from the scope of the present invention.

By way of example, FIGS. 22 through 25 illustrate alternative embodiments of the invention wherein the configuration of the positioning section rearward portion 70 is different than that shown in FIGS. 1 through 21.

Typically, the positioning section forward portion 72 is slanted substantially upwardly in a forward direction. It should however be understood that the positioning section forward portion 72 could be otherwise configured without departing from the scope of the present invention.

In at least some embodiments of the invention, the thumb positioning section 68 is made out of a different material than that of an adjacent area. For example, the thumb positioning section 68 could be made out of a substantially resilient material. For example, the thumb positioning section 68 could be out of an elastomeric resin. In at least one embodiment of the invention, the thumb positioning section 68 is made out of Santoprene (a trade mark).

In at least some embodiments of the invention, the thumb positioning section 68 is at least partially and preferably fully surrounded by a positioning section peripheral rim 74.

Typically, the implement handle 10 further comprises a spacing section 76 for spacing the fingers 14 through 22 from the implement head (not shown). The spacing section 76 extends between the body forward end 32 and between those indentations 46 and the thumb rest area 42. Typically, although by no means exclusively, the spacing section 76 has a substantially frusto-conical configuration.

Typically, although by no means exclusively, the body of the implement handle 10 is still further provided with the body aperture 78 extending transversally therethrough. Typically, the body aperture 78 is positioned substantially adjacent to the body rearward end 34.

In general terms, as illustrated in FIG. 4, the body of the implement handle 10 is configured so as to define a longitudinal cross-sectional configuration having a substantially graspable or encirclable section 40 tapering rearwards towards the body rearward end 34 and frontwardly towards a neck section 80. The neck section 80 diverges frontwardly into an abutment section 82.

The neck and abutment sections 80, 82 together define a thumb rest area 42 on the body top surface 36 and an index rest area on the body bottom surface 38. The abutment section 82 tapers frontwardly into a spacing section 76 for spacing the fingers 14 through 22 from the implement head (not shown).

The neck section 80 typically defines a top surface nadir and a bottom surface nadir. The top surface nadir if forwardly offset relative to the bottom surface nadir. Similarly, the abutment section 82 defines a top surface peak and a bottom surface peak. The top surface peak is forwardly offset relative to the bottom surface peak.

As shown more specifically in FIG. 5, generally speaking, when seen in a top view, the implement handle body defines a substantially stretched out hour-glass configuration tapering substantially about the neck spacing sections 80, 76. Typically, the neck section 80 is offset forwardly relative to the body forward and rearward ends 32, 34.

In use, the intended user first positions his/her thumb 14 so that the distal pulp section 28 thereof abutingly contacts the thumb rest area 42. The middle, ring and small fingers, 18, 20 and 22 are then wrapped around the encirclable section 40 for pressing the latter against the palm 24 while the index finger 16 is positioned in the indentation 46, with at least a portion of the lateral section 26 and of the pulp section 28 thereof in abutting contact with the indentation surface 48.

It should be noted that during oblique flexion of the last four digits, the index, middle, annular and small fingers 16 through 22, only the index ray flexes towards the median axis in a somewhat perpendicular relationship with the body longitudinal axis 30. This corresponds to the normal physiological alignment of the digits when the latter are flexed separately at the metacarpophalangeal and proximal interphalangeal joints so that their respective axes physiologically converge towards the scaphoid tubercle. The configuration of the encirclable section 40 allows the digits to be ergonomically wrapped, at least partially therearound.

By having the digits 16 through 22 urge the encirclable portion 40 against the palm 24, the benefits of a power grip including strength and force are provided. Also, by allowing the index and thumb fingers 16, 14 to be in opposition relative to each other, benefits of a pinch grip, including precision and accuracy are also provided.

Furthermore, all of the fingers 14 through 22 as well as the palm 24 are provided with optimized contact surfaces so as to reduce the need for a strong gripping force to be applied and so as to distribute the stress on a larger contact surface hence reducing the pressure on the pressure points.

I claim:

1. A handle implement comprising:

an elongated body having a tapered front side and a tapered rear end, top and bottom surfaces and opposing sides, said body being generally rounded and being generally parallel to a longitudinal axis at the center of said body, said tapered front side and said tapered rear end are situated on and taper toward said longitudinal axis at the center of said body, said tapered rear end leading to a rear tip end which is situated on the outermost surface of said implement, said rear tip end is situated on and tapers towards said axis;

a thumb positioning section situated on said top surface of said body adjacent to said front side of said body, said thumb positioning section comprising a concave indentation, said thumb positioning section sloping downwardly from said indentation towards said opposing sides of said body, said thumb positioning section comprising a thumb rest section, said thumb rest section having an outer edge, said outer edge of said thumb rest section having a rim portion around said outer edge, said thumb rest section being comprised of a different material than the rest of the thumb positioning section; and an index finger rest section situated on said bottom surface of said body adjacent to said front side of said body, said index finger rest section comprising a cavity with an extended protrusion, said protrusion designed to cover at least a portion of user's index finger, said protrusion slopes downwardly and away from said front side and slopes towards said rear end, said tapered front end having an elongated front tip end, said front tip end narrows in circumference as it extends away from said thumb positioning section and said index finger rest section, said front tip end has an oval cross section.

2. The implement of claim 1 further comprising an encirclable section situated adjacent said rear end of said body, said section being generally rounded in its circumference.

3. The implement of claim 2 wherein said encirclable section is designed to support user's palms and three fingers.

4. The implement of claim 1 wherein said thumb positioning section is situated above said index finger rest section.

5. The implement of claim 1 further comprising an aperture situated adjacent said rear end of said body.

6. The implement of claim 1 wherein said thumb rest section is recessed relative to said thumb positioning section.

7. The implement of claim 1 wherein said thumb rest section protrudes relative to said thumb positioning section.

8. The implement of claim 1 wherein said tapered front and rear ends extend outwardly has said ends move towards said index finger rest section and then tapers adjacent said index finger rest section.

9. The implement of claim 1 wherein said tapered front and rear ends extend outwardly has said ends move towards said thumb positioning section and then tapers adjacent said thumb positioning section.

10. The implement of claim 1 wherein said thumb rest section is constructed of a different material relative to said body and said thumb positioning section.

11. A handle implement comprising:

an elongated body having a tapered front side and a tapered rear end, top and bottom surfaces and opposing sides, said body being generally rounded and being generally parallel to a longitudinal axis at the center of said body, said tapered front side and said tapered rear end are situated on and taper toward said longitudinal axis at the center of said body, said tapered rear end leading to a rear tip end which is situated on the outermost surface of said implement, said rear tip end is situated on and tapers towards said axis;

a thumb positioning section situated on said top surface of said body adjacent to said front side of said body, said thumb positioning section comprising a concave indentation, said thumb positioning section sloping downwardly from said indentation towards said opposing sides of said body, said thumb positioning section comprising a thumb rest section, said thumb rest section having an outer edge, said outer edge of said thumb rest section having a rim portion around said outer edge, said thumb rest section being comprised of a different material than the rest of the thumb positioning section; and an encirclable section situated adjacent said rear end of said body, said section being generally rounded in its circumference, said tapered front end having an elongated front tip end, said front tip end narrows in circumference as it extends away from said thumb positioning section, said front tip end has an oval cross section.

12. The implement of claim 11 wherein said encirclable section is designed to support user's palms and three fingers.

13. The implement of claim 11 wherein said thumb positioning section is situated above said index finger rest section.

14. The implement of claim 11 wherein said tapered front and rear ends extend outwardly toward one another and then tapers adjacent said thumb positioning section, said expansion of said rear end forming said encirclable section.

15. The implement of claim 11 wherein said thumb rest section is recessed relative to said thumb positioning section.

16. The implement of claim 11 wherein said thumb rest section protrudes relative to said thumb positioning section.

17. The implement of claim 11 wherein said thumb rest section comprises a friction enhancing surface texture.

18. The implement of claim 11 wherein said thumb rest section comprises friction enhancing protrusions extending therefrom.

19. The implement of claim 11 wherein said thumb rest section is constructed of a different material relative to said body and said thumb positioning section.

* * * * *